US006218098B1

(12) United States Patent
Jezequel et al.

(10) Patent No.: US 6,218,098 B1
(45) Date of Patent: Apr. 17, 2001

(54) PROCESS FOR PREPARING A PHOTOGRAPHIC EMULSION COMPRISING SILVER HALIDE GRAINS WITH HIGH SILVER CHLORIDE CONTENT

(75) Inventors: Pierre-Henri Jezequel, Givry; Christian S. Schmuckle, Chalon sur Saone, both of (FR)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/388,745

(22) Filed: Sep. 2, 1999

(30) Foreign Application Priority Data

Sep. 3, 1998 (FR) ..... 98 11161

(51) Int. Cl.[7] ..... G03C 1/015
(52) U.S. Cl. ..... 430/569; 430/567
(58) Field of Search ..... 430/567, 569

(56) References Cited

U.S. PATENT DOCUMENTS

| | | | | |
|---|---|---|---|---|
| 5,254,454 | | 10/1993 | Mimiya et al. . | |
| 5,264,338 | * | 11/1993 | Urabe et al. | 430/568 |
| 5,709,990 | * | 1/1998 | Jezequel et al. | 430/569 |
| 5,723,279 | * | 3/1998 | Jezequel | 430/569 |
| 6,048,683 | * | 4/2000 | Mehta et al. | 430/567 |

FOREIGN PATENT DOCUMENTS 431 584 A1 6/1991 (EP) .

OTHER PUBLICATIONS

James et al, The theory of the Photographic Process, Machi Ken Publishing Co, U.S.A. p. 1, 1977.*

* cited by examiner

*Primary Examiner*—Hoa Van Le
*Assistant Examiner*—Amanda C. Walke
(74) *Attorney, Agent, or Firm*—Andrew J. Anderson

(57) ABSTRACT

A process for the preparation of a high chloride silver halide grain emulsion in which at least 50% of the projected area of the emulsion grains is accounted for by cubic grains, said process comprising:

i) precipitating an intermediate emulsion containing high chloride cubic nuclei having an average edge length less than or equal to 0.07 $\mu$m, by adding to an external continuous reactor at least one silver salt aqueous solution, a chloride salt aqueous solution and a hydrophilic colloid aqueous solution, in conditions so that (Qgel*Tgel)/(Qag*CAg) is more than 100, wherein Qgel is the flow rate of the hydrophilic colloid aqueous solution, Tgel is the hydrophilic colloid content of the hydrophilic colloid solution (g/l), QAg is the flow rate of the silver salt aqueous solution, CAg is the silver concentration of the silver salt aqueous solution (mole/l) and is comprised between 0.01 and 5 moles/l, the average pCl in the external reactor being between 1.7 and 3.5, ii) continuously transferring the intermediate emulsion containing the cubic nuclei from the external continuous reactor to a storage vessel, iii) stabilizing the nuclei by the addition of a growth inhibitor in an amount such as the nuclei coverage by the growth inhibitor is at least 20%, and iv) growing the nuclei of the intermediate emulsion to obtain a high chloride emulsion comprising cubic grains by adding a silver salt aqueous solution and a halide salt aqueous solution provided that the silver salt solution is added with a flow rate that does not lead the formation of new stable nuclei.

12 Claims, 1 Drawing Sheet

PROCESS FOR PREPARING A PHOTOGRAPHIC EMULSION COMPRISING SILVER HALIDE GRAINS WITH HIGH SILVER CHLORIDE CONTENT

FIELD OF THE INVENTION

The present invention relates to a new preparation process for a silver halide photographic emulsion with high silver chloride content and cubic grains, and to the emulsion thus obtained.

BACKGROUND OF THE INVENTION

Silver halide emulsions have always been used in photographic light-sensitive materials. The preparation of silver halide grains comprises two conventional steps, a nucleation step and a growth step.

For the nucleation step, there are various conventional processes. The single-jet process comprises adding a silver halide aqueous solution into a stirred reactor containing a colloid, usually gelatin, and a halide aqueous solution. In the double-jet processes, the silver salt and halide solutions are added simultaneously or alternately from two separate sources into a stirred reactor containing the colloid. In both cases, growth is generally obtained by a double-jet precipitation.

In the conventional processes, it may be difficult to correlate the number of nuclei obtained with the final number of grains, especially because of the Ostwald ripening which favors the growth of large grains rather than small grains, due to their different solubility. For a given number of nuclei, the number of grains after growth will usually be less than the number of nuclei.

There is a third process which comprises carrying out the nucleation step inside a first reactor by simultaneously adding the silver salt solution, the halide solution and the colloid solution, and in carrying out the growth step in a second reactor by adding a silver salt solution and one or more halide solutions.

In the prior art, the preparation process for ultra-thin silver halide emulsions is well known and comprises using, for example, growth inhibitors. The Patent Application EP 431 584 describes a preparation process for an ultra-thin grain emulsion with grain size less than or equal to 0.05 $\mu$m. The preparation process for such an emulsion includes adding a silver salt solution and a halide solution into a stirred reactor containing at least one high molecular weight compound and a compound capable of adsorbing on the silver halide grains, given that the high molecular weight compound and the growth inhibitor both have a retarding effect.

U.S. Pat. No. 5,254,454 describes a preparation process of silver halide grains for photographic emulsion, wherein the nucleation step is carried out in a strongly stirred mixer (10,000 rpm) by adding a silver salt solution, a halide solution and a colloid solution. According to U.S. Pat. No. 5,254,454, a first emulsion is thus obtained which contains fine silver halide grains (size less than or equal to 0.01 $\mu$m). This first emulsion is then transferred to a reactor in which the pAg is modified. The modified emulsion is then transferred to a second reactor containing a second emulsion composed of nuclei. The nuclei contained in the second reactor will encourage, after dissolution, the growth of the fine grains of the first emulsion.

Considering the variety of silver halide photographic emulsions used in photographic materials, it would be highly preferable to have a preparation process, using a single nucleation step, of emulsions that exhibit identical or different silver halide grain size or grain size diversity.

SUMMARY OF THE INVENTION

This is the object of the present invention which relates to a preparation process for silver halide emulsion wherein at least 50% of the projected area of the emulsion grains is accounted for by high chloride cubic grains. The process comprises:

i) precipitating an intermediate emulsion comprising high chloride content cubic nuclei having an average edge length that is less than or equal to 0.07 $\mu$m, by adding to an external continuous reaction vessel at least one silver salt aqueous solution, one chloride salt aqueous solution and one hydrophilic colloid aqueous solution, under conditions where (Qgel.TGel)/(QAg.CAg) is more than 100, wherein Qgel is the flow rate of the hydrophilic colloid aqueous solution, Tgel is the hydrophilic colloid content in the hydrophilic colloid solution (g/l), QAg is the silver salt aqueous solution flow rate, CAg is the silver content of the silver salt aqueous solution (mole/l), CAg being between 0.01 and 5 mole/l, with average pCl in the external reaction vessel of between 1.7 and 3.5, ii) continuously transferring the intermediate emulsion containing the nuclei from the external continuous reaction vessel to a storage vessel, iii) stabilizing the nuclei by adding growth inhibitor in a quantity so that the coverage of the nuclei by the growth inhibitor is at least 20%, and iv) growing the nuclei of the intermediate emulsion to obtain a high chloride emulsion comprising cubic grains.

The flow rate of hydrophilic colloid aqueous solution Qgel and the flow rate of silver salt aqueous solution QAg must be expressed in the same unit.

Using the process of the present invention, it is possible to obtain an intermediate emulsion comprising stabilized cubic nuclei having an average edge length less than or equal to 0.07 $\mu$m, which after growth allows a photographic emulsion to be obtained comprising larger cubic grains with high chloride content.

It is especially advantageous to be able to divide the intermediate emulsion obtained in step ii) into several parts and to carry out on each part a specific growth step. In this way from a single nucleation step several emulsions are obtained comprising cubic grains with a high silver chloride content that have various sizes and/or size variations and/or compositions.

The process of the present invention exhibits a high reproducibility and has improved robustness compared with the existing processes, because it is well known that the most delicate step for obtaining grains with a particular morphology is the nucleation step.

It is also desirable to obtain a preparation process for silver halide emulsions that has high productivity, i.e. a process capable of producing at least 0.6 moles of silver halide per liter of emulsion and per operation.

BRIEF DESCRIPTION OF THE DRAWINGS

Other characteristics will appear on reading the following description, with reference to the drawing wherein.

DETAILED DESCRIPTION OF THE INVENTION

Figure 1:
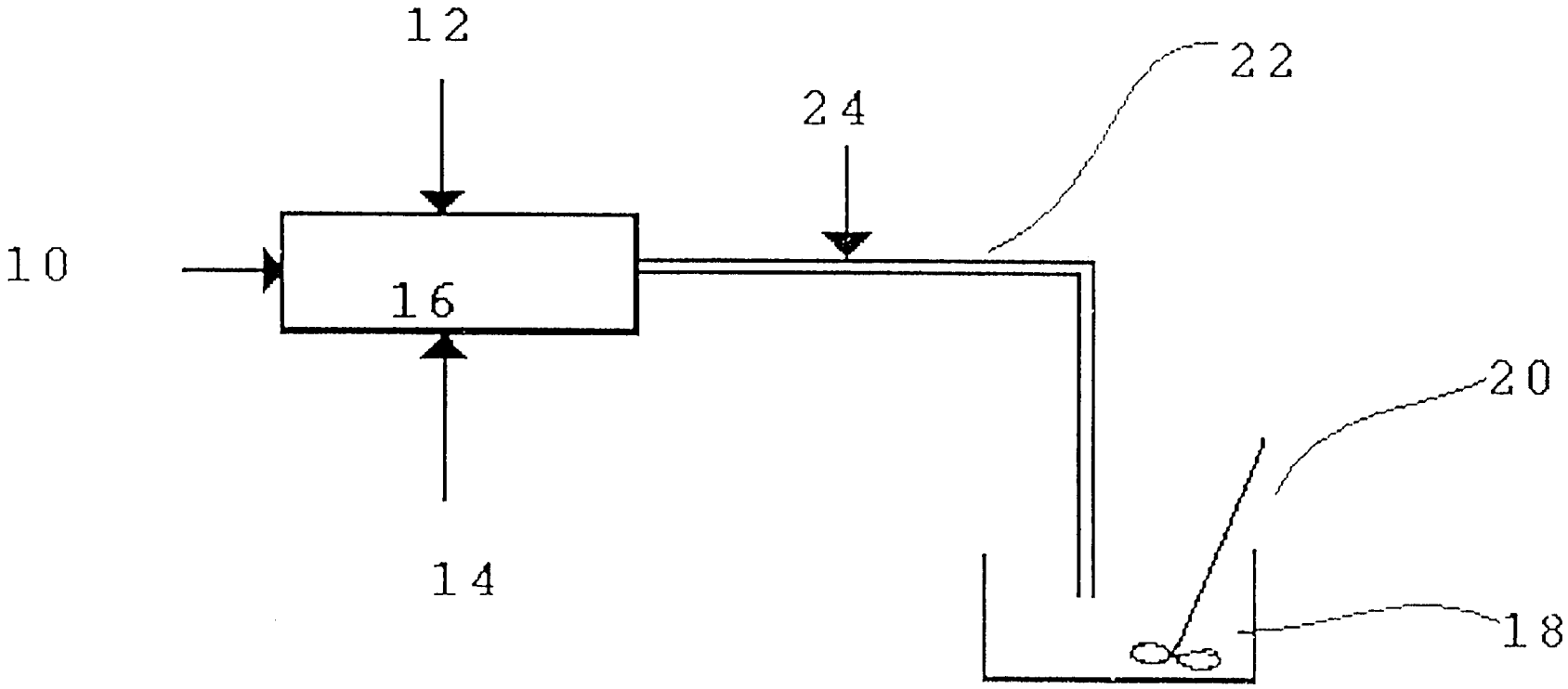
FIG. 1 represents a particular embodiment of the process of the present invention.

In the scope of the present invention, cubic nuclei and grains with a high chloride content are grains or nuclei that contain at least 50% mole of chloride compared to the total number of silver moles, preferably at least 70%, the rest being made up of bromide and iodide or a mixture of bromide and iodide. Grains saturated in iodide can be obtained, however it is desirable to keep the iodide content less than 5% mole. According to a particular embodiment of the invention, the silver halide grains and nuclei are 100% chloride.

The emulsion obtained by the process of the present invention is such that at least 70%, preferably at least 90% of the projected area of the emulsion grains is accounted for by cubic grains.

The nuclei that are obtained in step i) of the process of the present invention have an average edge length preferably less than or equal to 0.05 $\mu$m, and more preferably less than or equal to 0.03 $\mu$m. In fact, the smaller the size of the intermediate emulsion, the greater the variety of the emulsions that can be obtained from the same intermediate emulsion.

The external continuous reactor is a reactor designed so that the distribution of the staying times of each nuclei in the reactor is very narrow. The external continuous reactor is fitted with means for adding solutions of silver salt, chloride salt and hydrophilic colloid. When these solutions make contact, the nuclei form essentially instantaneously. The formation of the nuclei can be encouraged by, fitting the reactor with stirring means or by increasing the flows QAg, Qgel and Qx, Qx being the flow of the halide salt solution. The time the nuclei stay in the reactor is determined by the structure of the reactor.

The silver salt solution is an aqueous solution containing a quantity of silver salt such as silver nitrate, preferably from 0.1 mole/liter to 3 mole/liter, more especially from 0.2 mole/liter to 1 mole/liter.

The chloride salt solution may be a solution of ammonium chloride, chloride of alkaline metal or chloride of alkaline-earth. For example, the chloride salt can be a chloride of sodium, potassium, lithium, or calcium. The concentration of this solution is preferably from 0.1 mole/liter to 3 mole/liter, more especially from 0.2 mole/liter and 1 mole/liter.

The hydrophilic colloid solution is an aqueous solution that can contain gelatin or a gelatin derivative, or other binders well known for preparing photographic emulsions. Such colloids are described in Research Disclosure, September 1994, No 36544, part II A. Low molecular weight gelatin prevents having high viscosity. According to a particular embodiment, the gelatin can be previously mixed with the halide.

The external continuous reactor is preferably maintained at a temperature less than 50° C. and more especially less than 40° C.

The nuclei formed in the external continuous reactor are continuously transferred to a storage vessel, preferably fitted with a stirrer.

Growth inhibitors useful in the scope of the invention are compounds which act to inhibit the growth of silver chloride crystals by adsorbing on these crystals.

Any known growth inhibitors can be useful in the present invention. Growth inhibitors known in the prior art are organic compounds, for example spectral sensitizing dyes, antifoggants, stabilizers, sulfur sensitizers.

According to one embodiment, growth inhibitors include organic compounds comprising a heterocyclic group with 5 or 6 members containing 1 to 4 heteroatoms including at least one divalent sulfur atom or one trivalent nitrogen atom. These compounds often comprise at least one fused cycle with 5 or 6 members. Such growth inhibitors may be, for instance, the tetra-azaindenes, mercaptotetrazoles, adinine, guanine, xanthine, and their derivatives, pyrimidine, purines, azoles, etc. According to a particular embodiment of the invention, the growth inhibitor is a tetra-azaindene.

According to one embodiment of the invention, the quantity of the growth inhibitor is such that the coverage of the nuclei by the inhibitor is at least 20%, based on the total nuclei surface area and preferably at least 50%.

In the scope of the invention, the coverage is calculated from the surface area of nuclei covered with a monomolecular layer of growth inhibitor, compared with the total nuclei surface area. The quantity required to obtain the recommended coverage is determined from the total nuclei surface area obtained from their size and number and the molecular surface area of the growth inhibitor when it is adsorbed on the nuclei.

The growth inhibitor can be present in the storage vessel when the intermediate emulsion is transferred. The growth inhibitor can be added between the external continuous reactor and the storage vessel. It can also be mixed with one of the aqueous solutions added to the external continuous reactor.

The step of nuclei growth, whether it takes place immediately after nucleation or after a storage period of the nuclei uses the double-jet technique. A silver salt solution and a halide salt solution are added simultaneously to a suitable reactor containing all or part of the intermediate emulsion comprising cubic nuclei with high chloride content and average edge length less than or equal to 0.07 $\mu$m, in conditions of pCl and temperature providing the growing of cubic grains. According to a preferred embodiment, temperature during growth is about 40° C. and pCl during growth is held constant at 2.4.

When the growing step is carried out with silver salt flow rate conditions that do not lead the formation of new nuclei, each nuclei present in the reactor unexpectedly grows in such a way as to produce a cubic grain whose edge length depends on the quantity of silver added during growth despite the presence of the nuclei growth inhibitor. The flow rate conditions that do not lead the formation of new nuclei depends on the operating conditions and can be easily determined by one skilled in the art. According to a preferred embodiment, the molar flow rates of the silver salt solution during growth are between 0.5 times and 0.99 times the silver salt flow rates that lead to the formation of new stable nuclei. According to a particular embodiment, growth is obtained at a pH between 2 and 4.

One example of carrying out the process of the present invention is shown in FIG. 1, in which a silver salt solution 10, a halide salt solution 12 and a gelatin solution 14 are added to the external continuous reactor 16. When several silver halides have to be added to the continuous reactor, these halides can be added either mixed in the same solution, or by means of several solutions. The silver halide nuclei form at the meeting point of the three solutions 10, 12, 14. After an average stay in the defined reactor, the nuclei are transferred continuously to the storage vessel 18, fitted with a stirrer, through the channel 22.

According to a first embodiment of the invention, the growth inhibitor is present in the storage vessel 18 when the nuclei are added to it. According to a second embodiment of the invention, the growth inhibitor is added at the output from the continuous external reactor 16. According to a particular embodiment, the growth inhibitor is added near the input 24 located between the output of the continuous reactor 16 and the storage vessel 18. The flow rate for adding the growth inhibitor is determined according to the emulsion flow rate at the output of the external continuous reactor.

A very large number of stable nuclei can thus be formed. In particular, Ostwald type ripening does not occur. The process of the present invention allows an intermediate emulsion to be obtained containing nuclei having an average edge length less than or equal to 0.07 $\mu$m, preferably less than or equal to 0.05 $\mu$m, the nuclei having adsorbed a growth inhibitor on the surface, and the nuclei concentration in the colloid being more than $10^{16}$ nuclei/liter.

According to the process of the present invention, the growth of these nuclei takes place either directly, or after storage. After the nuclei growing, it is obtained a final silver halide emulsion containing grains having an average edge length more than that of the intermediate emulsion nuclei. As the intermediate emulsion nuclei are stable, the final emulsion can be prepared after several weeks storage.

According to an especially interesting embodiment, the intermediate emulsion containing the stabilized nuclei is divided into several parts each containing a set number of nuclei. Then a specific growth step is applied to each part. Thus, from the same intermediate emulsion containing stable nuclei it is possible to obtain emulsions that are different in average size and/or in composition and/or in size distribution. For example, with a single intermediate emulsion containing nuclei, it is possible to prepare the emulsions required to make a photographic product comprising several layers of photographic emulsions each having its own speed. Thus from a single intermediate emulsion it is possible to make color photographic products, that conventionally comprise at least one emulsion layer sensitive to red light, at least one emulsion layer sensitive to blue light and at least one emulsion layer sensitive to green light, where each of these layers can contain one or more silver halide emulsions.

The present invention is shown in detail in the following examples.

EXAMPLE 1

(Comparative)

Upstream from a T-shaped external continuous reactor with internal volume of about 10 ml, using a first T-shaped continuous reactor, an aqueous solution was premixed having gelatin content Tgel of 120 g/l with flow rate Qgel of 1250 $cm^3$/min, and sodium chloride content at 0.805 mole/liter with flow rate of 90 $cm^3$/min. The resulting solution was added continuously to the T reactor, as well as a silver nitrate aqueous solution having silver concentration of 0.8 mole/liter with flow rate QAg of 90 $cm^3$/min, and the solutions were maintained at a temperature of 40° C. An average pCl of 2.6 was maintained in the T reactor.

The nuclei thus formed were transferred continuously for a period of 3 minutes into a 20-liter storage vessel, initially containing 2 liters of water and sodium chloride at concentration of 0.327 g/l. The storage vessel was stirred at a speed of 2500 rpm with a turbine.

The average edge length of the nuclei obtained was measured using turbidimetric methods in the storage vessel. At this stage, it was about 0.07 $\mu$m. It was noticed that the optical density continued to evolve after nucleation, which indicated that the stored nuclei were not stable.

After waiting 60 sec, these nuclei were grown. Then solutions of silver nitrate at 3 moles/liter and silver chloride at 3 moles/liter were simultaneously added to the storage reactor. The flow rate of the silver nitrate solution was initially held at 5 $cm^3$/min for 3 min, and then increased linearly from 5 $cm^3$/min to 120 $cm^3$/min for 18.4 min, and then finally held constant at 120 $cm^3$/min for 22.6 min. The flow rates of the sodium chloride solution were adjusted so that the pCl was held constant at 2.4 throughout growth.

Thus 11.85 moles of an emulsion were obtained containing cubic grains whose average edge length, measured by scanning electron microscope, was 0.180 $\mu$m.

EXAMPLE 2

(Invention)

Upstream from a T-shaped external continuous reactor with internal volume of about 10 ml, using a first T-shaped continuous reactor an aqueous solution was premixed having gelatin content Tgel of 120 g/l with flow rate Qgel of 1250 $cm^3$/min, and sodium chloride at 0.805 mole/liter with flow rate of 90 $cm^3$/min. The resulting solution was added continuously to the T reactor, as well as silver nitrate aqueous solution having silver concentration of 0.8 mole/liter with flow rate QAg of 90 $cm^3$ min, and the solutions were maintained at a temperature of 40° C. An average pCl of 2.6 was maintained in the T reactor.

The nuclei thus formed were transferred continuously for a period of 3 minutes into a 20-liter storage vessel, initially containing 2 liters of water and sodium chloride at concentration of 0.327 g/l and 15 ml of an aqueous solution containing 50 g/l of growth inhibitor 4-hydroxy,6-methyl-1,3,3a,7-tetraazaindene (TAI). (theoretic coverage level of 147% ).

The storage vessel was stirred at a speed of 2500 rpm with a turbine.

The average edge length of the nuclei obtained was measured using turbidimetric methods in the storage vessel. At this stage, it was about 0.035 $\mu$m. It was noticed that the optical density remained constant after nucleation, which indicated that the stored nuclei were stable.

After waiting 60 sec, these nuclei were grown. Then solutions of silver nitrate at 3 moles/liter and silver chloride at 3 moles/liter were simultaneously added. The flow rate of the silver nitrate solution was initially held at 5 $cm^3$/min for 3 min and then increased linearly from 5 $cm^3$/min to 120 $cm^3$/min for 18.4 min and then finally held constant at 120 $cm^3$/min for 22.6 min. The flow rates of the sodium chloride solution were adjusted so that the pCl was held constant at 2.4 throughout growth.

Thus 11.85 moles of an emulsion were obtained containing cubic grains whose average edge length, measured by scanning electron microscope, was 0.134 $\mu$m.

EXAMPLE 3

(Invention)

Into an external continuous reactor with internal volume of 33 ml, stirred using a turbine at 2500 rpm, were added an aqueous solution having gelatin content Tgel of 120 g/l with flow rate Qgel of 1250 $cm^3$/min, a sodium chloride aqueous solution at 0.87 mole/liter with flow rate of 90 $cm^3$/min, a silver nitrate aqueous solution having silver concentration CAg of 0.8 mole/liter with flow rate QAg of 90 $cm^3$/min, and the solutions were held at a temperature of 40° C.

An average pCl of 2.35 was maintained in the T reactor.

After an average stay of 1.8 sec, the nuclei thus formed were transferred continuously for a period of 10 minutes into a 20-liter storage vessel, initially containing 4.5 liters of water, 135 g of gelatin and sodium chloride at concentration of 0.327 g/l. The storage vessel was stirred at a speed of 1500 rpm with a turbine. Stirring was maintained throughout the period of adding the nuclei.

A TAI aqueous solution at concentration of 50 g/l was added 20 cm from the output of the external continuous reactor with flow rate of 10 $cm^3$/min throughout the nucleation period.

Thus 0.72 mole of an intermediate emulsion was obtained containing nuclei whose average edge length, measured by turbidimetric methods, was about 0.040 $\mu$m. The number of nuclei obtained was $2.9\times10^{17}$ nuclei/liter.

The intermediate emulsion containing the nuclei thus obtained was stored for several days at a temperature of 6° C. (theoretic coverage level of 330%)

After storage, the average edge length of the nuclei was measured again, and a size of about 0.040 $\mu$m was obtained.

EXAMPLE 4

(Invention)

The intermediate emulsion from Example 3 was taken after storage. The actual concentration of silver halides in moles was measured again to allow for any evaporation effects. A growth step was then carried out based on a number of nuclei equal to $2.2\times10^{16}$ obtained by sampling 0.746 liter of the intermediate emulsion, using the conventional technique of double-jet precipitation. Thus, the emulsion containing the nuclei was put in a conventional stirred 20-liter reactor. Before starting growth, water and a quantity of gelatin giving a gelatin concentration of 50 g/l were added, together with a quantity of sodium chloride allowing the pCl to be adjusted to 2.35. The temperature was held at 40° C. throughout growth.

Then solutions of silver nitrate at 3 moles/liter and silver chloride at 3 moles/liter were simultaneously added. The flow rate of the silver nitrate solution was initially held at 10 $cm^3$/min for 7.5 min, and then increased linearly from 10 $cm^3$/min to 180 $cm^3$/min for 10.8 min, and then finally held constant at 180 $cm^3$/min for 34.11 min. The flow rates of the sodium chloride solution were adjusted so that the pCl was held constant at 2.35 throughout growth.

The silver halide emulsion thus obtained was washed. Thus 21.7 moles of an emulsion were obtained containing more than 90% of cubic grains of pure chloride whose average edge length, measured by scanning electron microscope, was 0.121 $\mu$m.

EXAMPLE 5

(Invention)

A growth step was again carried out using the nuclei obtained during the nucleation of Example 3. This growth was carried out on a number of nuclei equal to $7.4\times10^{16}$, obtained by sampling 2.690 liters of the intermediate emulsion, using the conventional technique of double-jet precipitation. The emulsion containing the nuclei was put in a conventional stirred 20-liter reactor. Before starting growth, water and a quantity of gelatin giving a gelatin concentration of 50 g/l were added, together with a quantity of sodium chloride allowing the pCl to be adjusted to 2.35. The temperature was held at 40° C. throughout growth.

Then solutions of silver nitrate at 3 moles/liter and silver chloride at 3 moles/liter were simultaneously added. The flow rate of the silver nitrate solution was initially held at 10 $cm^3$/min for 7.5 min, and then increased linearly from 10 $cm^3$/min to 180 $cm^3$/min for 10.8 min, and then finally held constant at 180 $cm^3$/min for 34.11 min. The flow rates of the sodium chloride solution were adjusted so that the pCl was held constant at 2.35 throughout growth.

The silver halide emulsion thus obtained was washed. Thus 21.7 moles of an emulsion were obtained containing more than 90% of cubic grains of pure chloride whose average edge length, measured by scanning electron microscope, was 0.150 $\mu$m.

The invention has been described in detail with particular reference to certain preferred embodiments thereof, but it will be understood that variations and modifications can be effected within the spirit and scope of the invention.

| PARTS LIST | |
|---|---|
| 10 | Silver salt solution |
| 12 | halide salt solution |
| 14 | gelatin solution |
| 16 | external continuous reactor |
| 18 | storage vessel |
| 22 | channel |
| 24 | input |

What is claimed is:

1. A process for the preparation of a high chloride silver halide grain emulsion in which at least 50% of the projected area of the emulsion grains is accounted for by cubic grains, said process comprising:

i) precipitating an intermediate emulsion containing high chloride cubic nuclei having an average edge length less than or equal to 0.07 $\mu$m, by adding to an external continuous reactor at least one silver salt aqueous solution, a chloride salt aqueous solution and a hydrophilic colloid aqueous solution, in conditions so that (Qgel*Tgel)/(Qag*CAg) is more than 100, wherein Qgel is the flow rate of the hydrophilic colloid aqueous solution, Tgel is the hydrophilic colloid content of the hydrophilic colloid solution (g/l), QAg is the flow rate of the silver salt aqueous solution, CAg is the silver concentration of the silver salt aqueous solution (mole/l) and is comprised between 0.01 and 5 moles/l, the average pCl in the external reactor being between 1.7 and 3.5, ii) continuously transferring the intermediate emulsion containing the cubic nuclei from the external continuous reactor to a storage vessel, iii) stabilizing the nuclei by the addition of a growth inhibitor in an amount such as the nuclei coverage by the growth inhibitor is at least 20%, and iv) growing the nuclei of the intermediate emulsion to obtain a high chloride emulsion comprising cubic grains by adding a silver salt aqueous solution and a halide salt aqueous solution provided that the silver salt solution is added with a flow rate that does not lead the formation of new stable nuclei.

2. The process of claim 1 wherein the quantity of growth inhibitor is such that the coverage of the nuclei by this inhibitor is at least 50%.

3. The process of claim 1 wherein the growth inhibitor is present in the storage vessel.

4. The process of claim 1 wherein the growth inhibitor is added during the transferring step of the nuclei from the external continuous reactor to the storage vessel.

5. The process of claim 1 wherein the growth inhibitor is present in one of the solutions added to the external reactor.

6. The process of claim 1 wherein the intermediate emulsion containing the stabilized nuclei is stored before growing step.

7. The process of claim 1 wherein the growing is separately applied to parts of the intermediate emulsion containing the stabilized nuclei.

8. The process of claim 1 wherein the growth inhibitor is an organic compound comprising a heterocyclic group with 5 or 6 members containing 1 to 4 heteroatoms including at least one divalent sulfur atom or one trivalent nitrogen atom.

9. The process of claim 1 wherein the growth inhibitor is a tetra-azaindene compound.

10. A process for the preparation of a silver halide emulsion comprising high chloride cubic grains, said process comprising: growing silver halide nuclei having an average size less than or equal to 0.07 $\mu$m and having adsorbed thereon a growth inhibitor with a coverage of at least 20% by adding a silver salt aqueous solution and a halide salt aqueous solution, provided that the silver salt solution is added with a flow rate that does not lead the formation of new stable nuclei.

11. The process of claim 10 wherein the silver salt solution is added with a molar flow rate between 0.5 times and 0.99 times the silver salt flow rate which would lead to the formation of new stable nuclei.

12. A photographic emulsion comprising high chloride silver halide cubic nuclei having an average size less than or equal to 0.07 $\mu$m having adsorbed thereon a growth inhibitor with coverage of at least 20% dispersed in a hydrophilic colloid wherein the nuclei concentration in the colloid is more than $10^{16}$ nuclei/liter.

* * * * *